United States Patent [19]

Jackson

[11] 3,959,028

[45] May 25, 1976

[54] PROCESS OF WORKING METALS COATED WITH A PROTECTIVE COATING

[75] Inventor: Raymond Pennoyer Jackson, Suffern, N.Y.

[73] Assignee: The International Nickel Company, Inc., New York, N.Y.

[22] Filed: Nov. 8, 1974

[21] Appl. No.: 522,030

Related U.S. Application Data

[62] Division of Ser. No. 307,862, Nov. 20, 1972, Pat. No. 3,861,938.

[52] U.S. Cl. ..... 148/11.5 R; 148/11.5 F; 148/12.1

[51] Int. Cl.[2] ..... C21D 7/13; C22F 1/08; C22F 1/10

[58] Field of Search ..... 148/11.5 R, 11.5 F, 148/12.1

[56] References Cited

UNITED STATES PATENTS

| | | | |
|---|---|---|---|
| 3,671,335 | 6/1972 | Pavlik | 148/12.1 |
| 3,827,922 | 8/1974 | Boggs et al. | 148/12.1 |
| 3,868,277 | 2/1975 | Leroy et al. | 148/12.1 |

*Primary Examiner*—W. Stallard

[57] ABSTRACT

A process for protecting metal from the deleterious effects of interaction with atmospheres surrounding said metal which comprises forming on the surface of said metal a continuous film of green chromium oxide and silica, the green chromium oxide portion of said film being directly bonded to the underlying base metal and coacting with the silica to provide a film impervious to gas at temperatures of about 500°C. to about 1300°C. The invention contemplates the product so protected and a composition of matter comprising chromium metal powder dispersed in an alkali-stabilized silica sol particularly adapted to be used in forming the green chromium oxide-silica film on metals.

3 Claims, No Drawings

PROCESS OF WORKING METALS COATED WITH A PROTECTIVE COATING

This is a division of application Ser. No. 307,862 filed Nov. 20, 1972, now U.S. Pat. No. 3,861,938.

The present invention is concerned with the protection of metal surfaces from interaction with the atmosphere surrounding them, especially at temperatures of hot working.

It is well known that certain metals, particularly iron and low alloy and tool steels, are subject to high temperature oxidation when heated above about 1000°F. (about 540°C.). For example, when heated in air up to 2350°F. (about 1290°C.), preliminary to hot rolling or forging, a low alloy steel can lose up to about 4% of its metal by scaling during the soaking period necessary to bring a billet up to working temperature. In an oxidizing atmosphere, a tool steel or a carbon-containing nickel anode material can lose a substantial percentage of the carbon content in the skin portion of the item being heated. Skin decarburization requires deskinning of the item which has been heated, or, alternatively, a separate operation of recarburizing. Under different circumstances where a metal such as iron is in contact at high temperatures with a carbon-containing atmosphere, it is possible to carburize the metal surface when carburization is not desired.

The problem with scaling of iron-base alloys is not limited to the scale loss mentioned hereinbefore. With some alloys, notably steel containing about 9% nickel useful for cryogenic and other purposes, scale formation tends to dilute the alloy surface of iron leaving a nickel-rich oxide layer on the alloy surface which oxide layer is very hard to remove by pickling. With some alloys, scale tends to adhere to more strongly or penetrate more deeply at certain locations as opposed to others. With such alloys, while the actual scale loss may not be excessive, additional losses are involved in the labor required to scarf or remove local patches of scale. If, as occasionally happens, a semiworked billet or slab is not thoroughly scarfed, the remaining scale patches become areas of defects in the product of further working. Although most scale, when cool, is brittle, hot scale is often sufficiently workable so that a minor scale defect on a slab can become a large defect area on a hot-rolled plate. With 9% nickel steel local penetration of oxides at grain boundaries is a severe problem.

The problems of scaling, carburization, decarburization and surface alloy enrichment (or depletion) are further magnified when the metal is not in dense, massive form but rather is in the form of a porous powder compact. In a porous powder compact, the surface of the metal extends into the innermost reaches of the body. Any undesirable reaction with an atmosphere occurs not only on the exterior surface which can be reached, but also on the interior surfaces which, after further compaction are completely inaccessible. Although in some instances a controlled amount of interior oxidation can be desirable and to avoid it, the powder metallurgy art customarily employs the step of inert atmosphere sintering of pressed powder compacts prior to hot working the compacts. Because a truly inert atmosphere sintering operation is costly, it would be highly advantageous to be able to sinter in atmosphere which are not truly inert, e.g., atmospheres having a relatively high dew point.

It has now been discovered that by means of a special process the surface of metals can be protected from interaction with the surrounding atmosphere especially at elevated temperatures and under conditions of mechanical deformation such as existing prior to and during hot rolling, hot forging and the like.

It is an object of the present invention to provide a novel process for protecting the surface of metals from interaction with surrounding atmospheres.

Another object of the present invention is to provide protected metal bodies specifically adapted to be exposed to oxidizing atmospheres at high temperatures, i.e., temperatures in excess of about 1000°F. (about 500°C.), and to be worked in said atmospheres at said high temperatures which protected metal bodies and the products of working said protected metal bodies are only minimally deteriorated, if at all, by oxidation, decarburization and the like at said temperatures.

A further object of the present invention is to provide novel compositions of matter useful in the process of protecting the surface of metals from interaction with surrounding atmospheres.

Further objects and advantages will become apparent from the following descriptions.

Generally speaking, the present invention contemplates a process for protecting metal from the deleterious effects of interaction with atmospheres surrounding said metal which comprises forming on the surface of said metal a continuous film of chromium oxide which is green at room temperature (i.e., a green chromium oxide) and silica, said film directly overlying the underlying metal and said green chromium oxide coacting with the silica and any copresent alkali metal oxide to provide a film impervious to gas at temperatures of about 500°C. to about 1300°C. The invention contemplates the product so protected and a composition of matter comprising chromium metal powder dispersed in an alkali-stabilized silica sol particularly adapted to be used in forming the green chromium oxide-silica film on metals.

Metals Which Can Be Protected

The present invention is particularly concerned with minimizing as far as possible scaling and decarburization of ferrous-base metals in oxidizing atmospheres. As used in the present specification and claims, the term "ferrous-base metals" includes iron-base alloys containing at least about 50% iron, up to 30% chromium and up to 30% of other alloying ingredients normally employed to provide steels of commerce. The process of the present invention is particularly useful in inhibiting or minimizing the scaling of ferrous-base alloys such as mild steel, 9% nickel steel and austenitic, ferritic and duplex structured stainless steels. The present process is also useful for inhibiting decarburization of tool steels and iron-base powder compacts containing free graphite.

While the ferrous-base alloys mentioned hereinbefore represent the greater bulk of metal production which can be facilitated by means of the present invention, the invention is also applicable to the protection of surfaces of other metals or alloys which are normally heat treated and worked in air and melt (i.e., have soliduses) at temperatures in excess of about 1000°C. and which contain from 0% to about 40% chromium. For example, the process of the present invention can be employed to prevent the formation of decarburized skins on carbon-depolarized nickel anode material and to inhibit oxidation of copper-base alloys, titanium-base alloys, nickel-base alloys and cobalt-base alloys. As with stainless steels, the value of the coating of the present invention with chromium-containing, nickel-base, and cobalt-base alloys is not so much to prevent metal loss by scaling but rather to minimize the formation of thin, tightly adherent, difficultly removable oxide layers which often penetrate preferentially in grain boundary regions.

Process

Metal to be protected in accordance with the present invention, having a clean metallic surface, i.e., a surface devoid of any substantial amount of non-metallic substances such as oxides, grease, etc., is coated with metallic chromium and an aqueous alkali-stabilized silica sol both components being applied either simultaneously or the chromium coating being applied first, the total thickness being at least one micron. The coated surface is then dried in such a manner as to provide a continuous dry film on the metal surface and to avoid blistering and thereafter fired in an atmosphere at least oxidizing to chromium to produce a composite, continuous, green chromium oxide-silica film directly overlying the underlying metal surface. For all practical purposes when hot working steel products, the chromium metal-silica film on the original billet can be as thick as desired but usually it need be no thicker than about 25 to about 60 or possibly 100 microns. Using electrodeposits of chromium followed by a silica coating derived from a silica sol as described hereinafter satisfactory results have been achieved with coatings as thin as about 10 microns. Under ordinary conditions, film will persist on the metal surface during hot working and will provide some lubricating effect. Clearly, the film on the product of hot working will be considerably thinner than the original film, perhaps by an order of magnitude or greater. Further, after hot working, it will often be found that chromium is diffused into the surface of the underlying metal.

The amount of chromium which is required to be coated on the clean metal surface differs substantially with the method of application and with the nature of the base metal. When chromium is electroplated on the surface or deposited by chromizing techniques, a layer of about $2 \times 10^{-5}$ inch (about $5 \times 10^{-5}$ cm.) (0.5 micron) on ferrous-base metal is all that is necessary. This thickness of chromium represents a dosage of about 3.6 grams of chromium per square meter of metal surface. It has been found that on low alloy steel which has been subsequently hot rolled, an electroplate of chromium 0.25 micron thick was not adequate for purposes of the invention. It is possible, however, that with alloys which contain substantial amounts of chromium within the range set forth hereinbefore a 0.25 micron thick electroplated chromium layer can sometimes be sufficient for purposes of the invention. With copper-base, nickel-base and cobalt-base alloys, it is necessary to use substantially more chromium than can conveniently be applied by electroplating.

Because electroplating and chromizing cannot always be conveniently carried out under prevailing industrial conditions and because of the chromium dosage requirements of alloys other than ferrous-base alloys, applicant also contemplates coating the metal to be protected with a layer of particulate chromium metal advantageously applied as a slurry in an aqueous, alkali-stabilized silica sol. The particles of chromium metal, when substantially equiaxed, advantageously have mean particle diameters in the range of about 0.001 micron to about 25 microns. With chromium particles of about 3 microns average dimension, it has been found that good results are obtained on steel to be hot worked with dosages of about 130 to 150 grams per square meter (g/m$^2$) of metal surface area. Reasonably good protection for short heating cycles is obtained on steel billets with dosages as low as about 50 g/m$^2$ of 3 microns sized chromium particles on the billet surface. This dosage is theoretically equivalent to a solid chromium layer about 7 microns thick. If desired, and especially when the metal is to be exposed to oxidizing atmospheres at high temperatures, e.g., about 1250°C. and higher, the dosage rates of chromium particles on the surface can be as high as about 500 grams per square meter.

Other means of providing a thin layer of chromium on the metal surface can also be used. For example, an iron-rich surface can be gas chromized with chromic chloride vapor. Chromium layers can be produced on any metal surface by thermal decomposition of chromium carbonyl and other thermally decomposable metallo-organic chromium compounds, such terminal decomposition processes being disclosed, for example, in U.S. Pat. No. 2,793,140 to Ostrofsky et al and in U.S. Pat. No. 2,898,235 to Bulloff.

The silica of the protecrive green chromium oxide-silica film used in the present invention is advantageously derived from the alkali-stabilized, aqueous silica sols marketed by E.I. duPont de Nemours and Company, Inc. (du Pont) under the trademark "Ludox" and other designations and made in accordance with the teachings of any one or more of the Bechtold et al U.S. Pat. No. 2,574,902, the Rule U.S. Pat. No. 2,577,485, the Alexander U.S. Pat. No. 2,750,345, the Bird U.S. Pat. No. 2,244,325, the Voorhees U.S. Pat. No. 2,457,971 and the Iler U.S. Pat. No. 2,668,149. Other silica sols are also operative provided that they contain an effective amount of alkali metal, e.g., sodium, potassium, lithium ion associated with the negative charge sites on the silica sol particles. Generally the mole ratio of silica to alkali metal in such sols is about 4:1 to about 400:1. Operative silica sols also can be modified to contain oxidic aluminum in place of part of the oxidic silicon on the surface of the silica sol particle. Such an alumina-modified silica sol is sold by du Pont under the trade designation "Ludox AM". While the aforedescribed alkali-stabilized silica sols are, at present, the best known means of providing the required silica in the green chromium oxide-silica films formed in situ on metal surfaces in accordance with the present invention, other means of forming silica films should not be overlooked. For example, silica films containing alkali metal ion can be obtained by alkali hydrolysis of ethyl silicate, by partial neutralization and dialysis of 1:1 sodium silicate (water-glass) solutions and other means well known to those skilled in the art. For purposes of the invention, however, it is necessary that at least about one mole of alkali metal ion associated with negative charge sites on the silica sol particle can be present for about every 400 moles of silica copresent. Dosage rates for the silica portion of the coating advantageously are of the order of 5 to 60 g/m$^2$ with associated ion from the group of sodium, potassium and lithium ion, measured as the oxide, advantageously being present in an amount of 0.5 to 2.5 parts for every 10 parts by weight of silica. Advantageously, when used as a slurry the chromium, silica and alkali metal ion are in weight ratios within the ranges of 6 to 10 parts by weight of chromium to 0.4 to 2 parts by weight of silica to 0.02 to 0.2 parts by weight of alkali metal oxide.

To complete the formation of the green chromium oxide-silica coating on the surface of the metal to be protected, the surface bearing the chromium, the silica and the alkali metal is exposed to an atmosphere containing oxygen or an oxygen donor which atmosphere is at least oxidizing to chromium. The surface should be held at about 1500°F. (about 800°C.). to about 1700°F. (about 930°C.) until the continuous green chromium oxide-silica film is established. Merely heating the object to be protected in furnace air up to 1700°F. (about 930°C.) (or higher) furnace temperature will ordinarily be a satisfactory method of establishing the protective coating of the present invention. However, if unusually fast heating means such as skin-effect induction heating is used, it will be necessary to maintain the coated surface at or about 1500°F. (about 800°C.) to about 1700°F. (about 930°C.) for some small amount of time, e.g., about 1 to about 5 minutes, under oxidizing conditions in order to achieve the protective coating. Those skilled in the art will appreciate that metallic chromium will react with oxygen to form chromic oxide ($Cr_2O_3$) and that this oxidation will produce about 133 kilocalories of heat per gram atomic weight of chromium. Thus, while the bulk of an object heated in a furnace to a furnace temperature of 1700°F. (about 930°C.) will have a maximum temperature of about 1700°F. (about 930°C.) local micro-volumes within the chromium-silica coating will be at substantially higher temperatures. It is believed that the localized increments of temperature plus the volume expansion occurring upon oxidation of chromium cause mutual wetting of closely spaced green chromium oxide particles and silica and the formation of a continuous protective film on the metal surface.

The film formed at 800°C. or higher protects the underlying metal from reaction with the atmosphere at high temperatures. It is to be understood, however, that in order for this film to be effective, it must directly overlie metal. Accordingly, it is necessary that the initially applied ingredients, i.e., chromium metal and silica form or be included in a film which will prevent oxidation of underlying metal prior to formation of the film of the present invention.

The amount of alkali metal ion present in the composition useful in the practice of the present invention is limited to the aforestated maximum amounts in relation to the silica in order to avoid formation of fully liquid silica-alkali metal oxide phases at the elevated temperatures at which protection is required, e.g., up to about 2350°F. (1290°C.). Based upon tests made at 2300°F. (1260°C.) on carbon steel specimens coated with chromium-containing, silica-lithia coatings having a range of ratios of silica to lithia at dosages between about 160 g/m² and about 230 g/m² (coating weight per metal surface area) maximum metal protection appears to be obtained with ratios of about 5 to 1 to about 17 to 1 by weight of silica to lithia. Based upon these same tests, it appears advantageous, when maximum metal protection is required at high temperatures, to avoid weight ratios of about 2 to 1 silica to lithia and about 28 to 1 silica to lithia.

Slurry compositions containing chromium metal particles dispersed in an alkali-stabilized aqueous silica sol and usable in accordance with the present invention for coating on metal to be protected can contain about 5 to about 10 parts by weight of chromium, about 0.4 to about 2 parts by weight of sol form silica, about 0.02 to about 0.3 parts by weight of alkali metal ion (measured as $Me_2O$) the ratio of silica to $Me_2O$ being at least about about 4, all components being dispersed or dissolved in about 4 to about 20 parts by weight of water.

Total solids weight of the coating per unit area of surface being protected is an important determinant of the protection providable by means of the slurry compositions of the present invention. Table I sets forth in terms of temperature, degrees of protection and solids dosage per unit area, typical results of protection and solids dosage per unit area, typical results obtainable with the slurry compositions of the present invention used on carbon steel which, after coating, was held at the indicated temperature for 1 hours.

TABLE 1

| | Dosage Rate (g/m²) of Slurry Solids | | | |
|---|---|---|---|---|
| | 1090°C. | 1150°C. | 1205°C. | 1250°C. |
| Minimum Protection | 49.5 | 80.7 | 94.5 | 107 |
| Medium Protection | 96.0 | 122 | 132 | 146 |
| Greater Protection | 146.0 | 167 | — | 194 |

The data set forth in Table I is pertinent to slurries made up with chromium powder of about 2 to about 3 microns average dimension and carefully fractionated to exclude particles outside this size range. When larger sized chromium particles are used, even in small amounts, in the slurry compositions of the invention, it is usually necessary to use much heavier layers of coating to achieve the same protection obtainable with lighter coatings of the slurries containing finer chromium particles.

Those skilled in the art will appreciate that water-soluble polar liquids such as alcohols, glycols, etc., can be substituted for some or all of the water in the slurry compositions of the present invention. However, in general, such substitution merely adds to cost and hazard without producing any particular advantages. Water-soluble or water-dispersible resins and other polymeric substances can sometimes be included with advantage in the chromium-containing slurry compositions of the present invention in order to increase viscosity, enhance the film forming of the silica sols and for other purposes. Some resins and polymeric substances compatible in the slurry compositions of the present invention are set forth in Table II. The list of Table II is given, however, with the caution that the materials listed therein should be used in small proportions, if at all, in order to avoid interference with the mechanisms involved in forming directly on underlying metal the continuous, green chromium oxide-silica film as described hereinbefore.

TABLE II

| RESINOUS POLYMERIC MATERIALS COMPATIBLE IN THE SLURRY COMPOSITIONS OF THE INVENTION | |
|---|---|
| Acrylic Co-polymer Emulsions | - e.g., Neo-cryl[1] A. 234.U or Rhoplex[2] D70 |
| Acrylic Emulsions | - e.g., RWL[3]-201 or Rhoplex B60A |
| Styrene-Acrylic Co-polymer Emulsions | - e.g., Vbatol[4]V-4001 |
| Polystyrene Emulsions | - e.g., Neo-Rex[1]S-71 or RWL 110 |
| Polyester Resins-Ammonia Cut | - e.g., Durez[5] 17211 or Durez 19788 |
| Polyethylene Glycols | - e.g., Carbowax[6] 4000 |
| Rosin-Maleic Anhydride Adducts | - Ammonia Cut |
| Styrene-Maleic Anhydride Co-polymers | - Ammonia Cut |
| Copal - Ammia Cut | - Na Carboxymethyl Cellulose |
| Methyl Cellulose | - Alkyl Hydroxyalkyl Celluloses |
| Polyvinyl Alcohol | - Polyacryllic Acid Ammonia Cut |
| Dextrins | - Gelatins |
| Alginates | - Gum Arabic |
| Gum Tragacanth | - Carob Gum |
| Mucilage | - Starch |
| Corn Syrups | - Xanthan Gum |
| Shellac - Ammonia cut | - Polyvinylpyrrolidone |

[1]Trademark of Polyvinyl Chemicals, Inc.
[2]Trademark of Morton Chemical Co.
[3]Product Designation of Morton Chemical Co.
[4]Trademark of U.B.S. Chemical Corp.
[5]Trademark of Hooker Chemical Corp.
[6]Trademark of Union Carbide Corp.

Those skilled in the art will appreciate that many of the natural products named in Table II which can be used as thickeners are subject to bacterial or enzyme deterioration. In order to inhibit deterioration, preservatives such as sodium phenate, sodium chlorophenate or other well-known bacteriocides or enzyme inactivators can also be included in the slurry compositions of the present invention in conventional amounts, e.g., 0.1%, based on weight of material being provided.

In order to maximize the formation of continuous films on metal surfaces, the chromium-containing slurry compositions of the present invention as well as the silica sols used with electroplated or chromized chromium layers advantageously contain either anionic or nonionic surfactants. Anionic surfactants such as sodium alkyl aryl sulfonate and sodium lauryl sulfate in amounts of 0.1% to 0.3% by weight based upon total silica plus alkali metal ion plus water are generally useful in the practice of the present invention. Nonionic surfactants such as ethylene oxide condensates, octylphenoxydiethoxyethanol, alkylphenoxy-poly(ethyleneoxy)ethanol, polyethylene glycol tertiary-dodecylthioether and trimethylnonanol can also be used especially in conjunction with alkali-stabilized silica sols having a $SiO_2/Me_2O$ ratio below about 120.

It is within the contemplation of the invention to include in the chromium-containing slurry compositions along with silica and the alkali metal ion, small amounts of other ingredients such as alumina, magnesia, lime, clay (e.g., bentonite), and like materials which can alter somewhat the character of the green chromium oxide-silica film on the protected metal surface. As a specific example, inclusion of aluminum in an amount of up to about 60% (by weight of the chromium metal present) in the slurry compositions of the present invention promotes pop-off of the film upon cooling after the steel has been heat treated. Table III sets forth (in percent by weight of chromium metal) amounts of these other ingredients which can be used in the slurry compositions of the present invention and which, in contrast to the organic additives set forth hereinbefore, do not burn off but rather become part of the fully oxidized film.

TABLE III

| Ingredient | % by weight of copresent chromium |
|---|---|
| $Al_2O_3$ | 10 |
| Ni | 200 |
| Al | 60 |
| Bentonite | 2 |
| Rare earth metal oxide | 2 |

Those skilled in the art will appreciate that metals such as aluminum cannot be copresent with relatively highly alkaline silica sols (e.g., sols having a $SiO_2/Me_2O$ ratio of less than 20) for any extended time without causing hydrogen evolution and sol gelation. Accordingly, if one desires to use aluminum in a slurry composition made with a highly alkaline silica sol, the aluminum should be added just prior to coating the slurry onto a metal surface. Use of rare earth metal oxide, e.g., yttrium oxide, is particularly advantageous when nickel and aluminum together are used to dilute the amount of chromium in the slurry compositions of the present invention.

In order to give those skilled in the art a better understanding and a greater appreciation of the invention, the following examples are given.

EXAMPLE 1

A clean piece of SAE 1020 carbon steel (1 × 1 × 6) (2.5 × 2.5 × 15.25 cm.) was coated over part of its surface by first, electroplating part of the surface with 0.00002 inch (about 0.00005 cm.) thickness of chromium from a standard chromic acid-sulfate bath, coating the plated portion of the surface with alkali-stabilized silica sol, allowing the sol to dry to a layer less than 1000 angstroms thick and heating the thus partially coated metal. The heating was in air up to 2000°F. (about 1090°C.) at which temperature the metal was held for one and one-half hours. The metal piece was then hot rolled to ⅜ inch (0.32 cm.) thickness. The non-treated portion had heavy loose scale as expected; whereas a very thin, tenacious green chromium oxide-silica coating was observed on the treated portion of the specimen. Metallographic examination revealed no decarburization under the protective layer and no scaling appeared on the protected surface. The alkali stabilized silica sol used in treating part of the surface of the metal piece had a $SiO_2/Me_2O$ weight ratio of 50.

EXAMPLE II

Specimens of Type 430 ferritic stainless steel and a duplex structured stainless steel were coated as was the coated portion of the steel piece in Example I. Similar specimens were given only the chromium plating treatment. Under oxidation in air at 1800°F. (about 980°C.) the specimens which were only chromium plated received no significant protection. Both of the specimens treated in accordance with the present invention had good oxidation resistance for 6 hours at 1800°F.

EXAMPLE III

A thirty pound ingot of $M_2$ tool steel (0.85% C, 4% Cr, 6.4% W, 5% Mo, balance essentially Fe) was cast and forged to a 2½ inch (6.35 cm.) bar. A piece of this bar was coated as described in Example I and heated to 2075°F. (about 1140°C.) in air for 30 minutes. The coating protected the surface from oxidation and give virtually complete resistance to decarburization.

EXAMPLE IV

A 9% nickel Steel (0.1% c, 9.0% Ni, 0.4% Mn, 0.3% Si, 0.015% P, 0.015% S, balance essentially Fe) in the form of a one-inch (about 2.5 cm.) diameter bar was partially coated with the green chromium oxide-silica film as described in Example I. The specimen was then soaked in air at 2100°F. (about 1150°C.) for 10 minutes and then air cooled. A loose scale formed on the uncoated portion of the specimen and, after it flaked off, a tenacious nickelrich oxide layer remained together with underlying grain boundary oxidation. In contrast, where the specimen had been coated, only slight oxidation resulted. The thin, protective green chromium oxide-silica film remained intact with no underlying nickel-rich scale or grain boundary penetration.

EXAMPLE V

An Armco iron specimen of very low carbon content was coated with the green chromium oxide-silica film as described in Example I and thereafter pack carburized at 1700°F. (about 930°C.) for 2 hours along with an uncoated specimen. After the treatment, both specimens were sectioned and examined metallographically. The uncoated specimen was carburized deeply; whereas, the coated specimen was not carburized at all.

It is to be observed that the coating used on the protected specimen in Example V was originally heated in air to a temperature of about 1700°F. (about 930°C.). Without this original heating in air, no green chromium oxidesilica film is formed and substantially no protection of the metal surface is obtained.

EXAMPLE VI

A clean sample of SAE 1020 steel was coated at a dosage of about 0.1 gram/in² (155 g/m²) with the dried residue of an aqueous slurry containing about 3.5 parts by weight of round grain chromium powder, the particles of which were about 3 microns in diameter, about 2.75 parts by weight of an aqueous lithium-stabilized silica sol sold by E. I. du Pont de Nemours and Company, Inc. as polysilicate 48 and containing about 20% by weight of $SiO_2$ and about 2.1% by weight $Li_2O$ with the balance being water and a volume of water equal to the volume of the silica sol. The coated sample was then heated in air to about 1700°F. (about 930°C.) to form a continuous green chromium oxide-silica film on the steel surface. The steel was then capable of resisting high temperature oxidation both prior to and during hot working in the same manner as the coated portion of the steel sample described in Example I.

To demonstrate that in situ oxidation of chromium metal particles is necessary for purposes of the invention, a slurry similar to the one used in Example VI was made up with green $Cr_2O_3$ rather than with chromium metal. This slurry was applied to a steel surface in the manner identical to that described in Example VI to provide an equivalent (chromium metal) dosage and then heated in air to 1700°F. (about 930°C.). The coating thus formed gave substantially no protection against scaling at hot working temperatures, i.e., temperatures well above 2000°F. Use of the dried silica sol alone gives marginal protection only and only up to about 1500°F. (about 815°C.).

EXAMPLE VII

A portion of a specimen of a 9% nickel steel similar to that steel described in Example IV was coated on a machine ground surface with a slurry containing about 8 parts by weight of 3 micron chromium powder, about 5.85 parts of the lithium-stabilized silica sol described in Example VI and about 5 parts by weight of water. The dried coating weighed approximately 0.094 g/in² (146 g/m²). The thus coated specimen was heated in air to 2100°F. (about 1150°C.). soaked four hours at this temperature and hot rolled from 1–3/16 inches (about 3.0 cm.) to ¼-inch (about 0.65 cm.) in 8 passes.

The portion of the specimen having the green chromium-silica coating was completely protected whereas the non-coated portion of the specimen scaled heavily. Metallographic examination indicated a diffusion of chromium into the steel surface for a distance of about 25 microinches (about 0.62 micron). The surface of the rolled product still contained the green chromium oxidesilica coating on that portion corresponding to the originally coated portion of the specimen. This green coating can be removed by pickling, for example, in 15% by weight sulfuric acid, dried at 65°C., or by sandblasting or by other methods well known to those skilled in the art.

EXAMPLES VIII - XIV

Examples of other aqueous silica sol slurry coating compositions in accordance with the present invention are set forth in Table IV.

TABLE IV

| Example No. | VII | IX | X | XI | XII | XIII | XIV | XV |
|---|---|---|---|---|---|---|---|---|
| Cr (pbw*) | 8 | 5 | 5 | 4 | 5 | 5 | 5 | 3 |
| Size of Cr particle (micron) | 3 | 3 | 3 | 3 | 3 | 3 | 3 | 3 |
| Al(pbw) | — | 1 | 3 | — | — | 1 | 1 | 1 |
| Sol(pbw) | 3.5 | 5.85 | 5.85 | 11.7 | 5.85 | 5.85 | 5.85 | 5.85 |
| Alkali metal | Na | Li | Li | Li | Li | Li | Li | Li |
| $Me_2O$(pbw) | 0.021 | 0.12 | 0.12 | 0.25 | 0.12 | 0.12 | 0.12 | 0.12 |
| $SiO_2$(pbw) | 1.05 | 1.17 | 1.17 | 2.34 | 1.17 | 1.17 | 1.17 | 1.17 |

TABLE IV-continued

| Example No. | VII | IX | X | XI | XII | XIII | XIV | XV |
|---|---|---|---|---|---|---|---|---|
| Dilution water (pbw) | 7.1 | 5 | 5 | 10 | 5 | 5 | 5 | 5 |
| $Y_2O_3$ | — | — | — | — | — | 0.1 | — | 0.1 |
| Ni | — | — | — | — | — | — | — | 5 |

*pbw = parts by weight

EXAMPLE XVI

Two specimens of carbon-depolarized nickel electroplating anode material, one coated with a dried layer of the slurry of Example VIII were soaked in air for two hours at 2100°F. (about 1150°C.) and then hot rolled from 1-3/16 inch (about 3.0 cm.) diameter bar to 5/8-inch (about 1.6 cm.) diameter bar. The surfaces of both hot rolled samples were cleaned by anodic pickling in hydrochloric acid (1 to 1 dilution with water of commercial concentrated HCl). Metallographic examination of the specimen which was coated showed no decarburized surface layer whereas the uncoated specimen was significantly decarburized at or near the surface. Subsequent testing of the specimen which had been coated as an anode in a nickel electroplating bath indicated that this specimen could be used as a depolarized anode without a preliminary deskinning operation in contrast to the specimen which was rolled without the coating of the present invention and which required deskinning.

EXAMPLE XVII

Four identical batches of mixed powders containing in percent by weight about 0.5% carbon (as graphite), about 0.5% each of nickel and molybdenum, about 0.3% manganese, with the balance being essentially iron, were compacted under 40 tons per square inch (t.s.i.) (i.e., about 56.2 kilograms per square millimeter ($kg/mm^2$)) and sintered at 2050°F. (about 1120°C.) for 30 minutes in a protective atmosphere. Two of the sintered compacts were coated with a chromium metal slurry in an aqueous silica sol in accordance with the present invention and allowed to dry. All four compacts were heated in air at 1700°F. (about 930°C.) as specified in Table V, which table also contains the results of a room temperature ultimate tensile test conducted upon the sintered and reheated compacts.

TABLE V

| Specimen | Coated | Time in Mins. at 1700°F. | U.T.S.* psi | U.T.S.* $kg/mm^2$ |
|---|---|---|---|---|
| A | No | 10 | 37,600 | 26.4 |
| B | Yes | 10 | 52,000 | 36.6 |
| C | No | 30 | 29,200 | 20.5 |

TABLE V-continued

| Specimen | Coated | Time in Mins. at 1700°F. | U.T.S.* psi | U.T.S.* $kg/mm^2$ |
|---|---|---|---|---|
| D | Yes | 30 | 50,700 | 35.1 |

*U.T.S. - Ultimate Tensile Strength of samples which were air cooled after heating at 1700°F. with no further heat treatment or mechanical working The data in Table V shows that the uncoated specimens were severely degraded by exposure to air at 1700°F. (about 930°C.) whereas the coated specimens were virtually unaffected, exhibiting ultimate tensile strengths corresponding to similar material heated in a protective atmosphere. The results shown in Table V are important insofar as they show that by means of the present invention one can heat powder compacts in air prior to forging and not be forced to use cumbersome means to heat in protective atmosphere.

EXAMPLE XVIII

Other tests carried out on powder masses containing in percent by weight 1% manganese, 4% nickel, 1% molybdenum, 0.5% carbon (as graphite) with the balance being essentially iron and compacted and sintered as described in Example XVII show that coating the compacts with chromium slurried in water or chromium slurried in alkali-stabilized silica sol will prevent oxidation of alloying elements during sintering in commercially available endothermic atmospheres, e.g., cracked ammonia of high dew point. After sintering, it is necessary, in order to obtain resistance to oxidation by formation of the green chromium oxide-silica film of the present invention, to recoat the sintered compact with alkali-stabilized silica sol. Specimen treatment and results pertinent to these other tests are set forth in Table VI.

TABLE VI

| Specimen | Pre-Sinter Coating | Post-Sinter Coating | Time at 1700°F. | U.T.S.* psi | U.T.S.* $kg/mm^2$ |
|---|---|---|---|---|---|
| E | None | None | 0 | 79,800 | 56.1 |
| F | Cr** | None | 0 | 95,000 | 66.7 |
| G | Cr+A.S. $SiO^2$*** | None | 0 | 96,600 | 67.9 |
| H | None | None | 30 min. | 47,000 | 33.0 |
| I | Cr+A.S. $SiO_2$ | None | 30 min. | 52,000 | 36.6 |
| J | Cr+A.S. $SiO_2$ | A.S. $SiO_2$ | 30 min. | 93,600 | 65.8 |

*Ultimate Tensile Strength of samples air cooled with no further heat treatment or mechanical working
**Chromium alone
***Chromium + Alkali-stabilized silica The data in Table VI as to specimens E to G shows that chromium alone is sufficient to protect a powder compact from deleterious oxidation in a cracked ammonia atmosphere of high dew point. However, when subsequent heating in air is contemplated, it is necessary, as shown by the data as to samples H, I and J, to recoat the compact with silica if the original coating was heated in a reducing atmosphere. While the reason for this is not fully known, it is possible that under reducing conditions in association with a porous metallic member, molten material rich in alkali metal oxide may be abstracted from the coating by capillary action or otherwise.

EXAMPLE XIX

A sample of a chromium-containing cupro-nickel alloy having a solidus of about 1170°C. and containing in percent by weight about 30% nickel, about 2.8% chromium, about 0.7% manganese, about 0.15% zirconium, about 0.05% titanium, with the balance being essentially copper was coated with a chromium alkali-stabilized silica sol slurry of the present invention and was heated in air, along with an uncoated sample, at about 1020°C. for 2 hours. The uncoated sample had a substantial metal loss whereas the coated sample had no loss. The uncoated sample had a difficultly removable oxide layer whereas the coated sample was easily cleanable. Microprobe analysis results of metal near the surface is set forth in Table VII, in which Table elemental content is in weight percent with oxygen being calculated by difference.

TABLE VII

| Sample | Distance from Surface (micron) | Ni (%) | Cu (%) | Cr (%) | O (%) |
|---|---|---|---|---|---|
| Uncoated | 6 | 31.0 | 54.8 | 2.6 | 11.6 |
| Uncoated | 15 | 32.5 | 63.7 | 2.5 | 1.2 |
| Coated | 6 | 31.9 | 67.1 | 2.7 | 0.0 |
| Coated | 15 | 30.8 | 68.1 | 2.8 | 0.0 |

The data of Table VII shows the complete effectiveness of the coating of the present invention in eliminating deterioration of the aforedescribed copper-base alloy by high temperature oxidation.

From the foregoing, those skilled in the art will appreciate that the present invention is broadly applicable to the protection of metals of the kind described hereinbefore from deleterious or undesirable reaction with the atmosphere surrounding them. It is to be understood that while best results are attained with the slurry aspect of the present invention using pure or essentially pure (unalloyed) chromium powder, useful results can also be attained through the use in slurry form of metal powder containing greater than about 60% chromium, e.g., various grades of ferro-chromium along with the alkali-stabilized silica sols and with or without additions of chromium powder. When ferrochrome is used, the iron copresent with chromium can alter the color of the coating from green to various shades of brown without entirely eliminating the effect of the chromium oxide present in the coating. Further, if will be appreciated that although the foregoing description of the present invention emphasizes the protection of metals at elevated temperatures, e.g., about 1500°F. (about 815°C.) to 2350°F. (about 1300°C.), the thin (i.e., up to about 100 microns thick) green chromium oxide-silica coatings of the present invention can also find use in protecting steel and other metals from atmospheric corrosion at any temperature. Thus, while it may at times be advantageous to include aluminum in the coatings of the present invention to provide for flake-off of the coating upon cooling after hot working, at other times it is advantageous to employ a coating of the invention which will be adherent to the cooled metal and thus help protect it from rusting under ambient storage conditions. The coatings of the invention adherent to cooled, hot worked steels and other metals are also highly useful as bases for organic and inorganic protective coatings such as paints, lacquers, bonded polymeric films, etc.

The coatings of the present invention are distinctly different, both in composition and in effectiveness, from silica coatings of the prior art such as disclosed in the Cupery et al U.S. Pat. No. 3,133,829. Samples of Type 304L stainless steel were treated as follows: Sample I was left uncoated as a control; Sample II was coated with a film derived from an alkali stabilized silica sol; and Sample III was coated with a composition of the present invention including chromium metal dispersed in an alkali-stabilized silica sol (coating weight 240 g/m²). All the samples were heated at 2200°F. (about 1200°C.) in air for 4 hours, cooled and pickled in an aqueous nitric acid-hydrofluoric acid pickling bath to bare metal. The control (Sample I) lost weight in an amount of about 186 g/m² of surface area, Sample II lost about 665 g/m² of surface area and Sample III gained about 12 g/m² of surface area. The surface finishes of Samples I and II were badly deteriorated whereas the surface finish of Sample III was barely affected by the heating and pickling operation. The data show that films derived from alkali-stabilized silica sol in the absence of chromium are not only not protective to low carbon nickel-containing stainless steel at 1200°C. in air but also appear to detrimentally affect the ability of the stainless steel to resist oxidation. Under the same conditions, the coating of the present invention is completely protective.

EXAMPLES XX TO XXIII

Further examples of slurry compositions of the present invention are set forth in Table VIII.

TABLE VIII

| Example No. | XX | XXI | XXII | XXIII |
|---|---|---|---|---|
| Cr (pbw) | 13 | 11.5 | 11.5 | 11.5 |
| Size of Cr particle (microns) | 3 | 3 | 3 | 3 |
| Sol (pbw) | 4.1 | 4.1 | 4.1 | 4.2 |
| Alkali metal | Li | Li | Li | Li |
| $Me_2O$ (pbw) | 0.086 | 0.086 | 0.086 | 0.176 |
| $SiO_2$ (pbw) | 0.82 | 0.82 | 0.82 | 0.82 |
| Dilution Water (pbw) | 3.5 | 3.5 | 3.5 | 3.5 |
| Carbopol* 941 | 0.03 | 0.03 | 0.03 | 0.03 |
| CaO | — | — | 0.1 | — |

*Dry acid-base, water soluble copolymer sold by B.F. Goodrich Chemical Co.

The composition of Example XXIII when applied on a carbon steel surface at a dosage rate of 180 g/m² limited weight loss from solid steel due to 2 hours exposure to oxidizing atmosphere at 1260°C. to about 150 g/m². Unprotected carbon steel subject to such exposure can be expected to exhibit metal weight losses due to scale formation of about 2000 to 3000 g/m². It is to be understood that in order to achieve the most advantage from the slurry compositions of the present invention, it is necessary to provide uniform continuous coatings of dry slurry solids on the metal to be protected. In this regard, it has been found advantageous to dilute commercially available, lithia-stabilized silica sol (20% by weight of silica) one to one by volume with water and to use about 0.4% by weight acid-base water soluble polymer in this sol-water mixture to provide a vehicle for chromium metal particles. The thus formulated vehicle is capable of efficiently carrying chromium particles onto a metal surface and retaining them there in a uniform continuous layer.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A process of working metal from the group consisting of iron-base, nickel base, cobalt-base and copper-base alloys comprising coating on the surface of a mass of said metal an aqueous slurry which contains about 5 to about 10 parts by weight of substantially equiaxed chromium particles having an average particle size of about 0.001 to about 25 microns, about 0.4 to about 2 parts by weight of sol form silica and about 0.02 to about 0.3 parts by weight of alkali metal ion measured as $Me_2O$ associated with said sol form silica with the ratio of silica to alkali metal oxide being at least about 4, heating the coated surface in an oxidizing atmosphere at a temperature of at least about 800°C., to provide a continuous, gas impermeable, film thereon, soaking said film coated metal mass in air at a temperature below the melting point of said metal to bring said metal mass to working temperature and, thereafter, working said metal to provide a worked metal object substantially devoid of products of oxidation of its metal on the surface thereof and substantially devoid of any skin depleted or enriched in alloy content through solid-gas reaction.

2. A process as in claim 1 wherein the metal mass is a compacted mass of metal powder.

3. A process as in claim 2 wherein the slurry is coated on an unsintered compacted mass of metal powder, the coated mass is then sintered in a non-oxidizing atmosphere, and is recoated with alkali-stabilized silica sol prior to reheating in an oxygen-containing atmosphere.

* * * * *